US006474337B1

(12) United States Patent
Acker et al.

(10) Patent No.: US 6,474,337 B1
(45) Date of Patent: Nov. 5, 2002

(54) UNIVERSAL OXYGEN MASK BAYONET AND BAYONET RECEIVER DEFLECTOR

(75) Inventors: Charles F Acker, Equinunk, PA (US); Robert Lamanna, Moscow, PA (US)

(73) Assignee: Gentex Corporation, Carbondale, PA (US)

( * ) Notice: Subject to any disclaimer, the term of this patent is extended or adjusted under 35 U.S.C. 154(b) by 0 days.

(21) Appl. No.: 09/872,192

(22) Filed: Jun. 1, 2001

(51) Int. Cl.[7] ..... A62B 18/08

(52) U.S. Cl. ..... 128/207.11; 128/201.24; 128/202.27

(58) Field of Search ..... 128/201.22, 201.24, 128/202.27, 206.27, 207.11; 24/614, 615, 629, 633, 644; 403/359.5, 397, 398

(56) References Cited

U.S. PATENT DOCUMENTS 4,457,461 A * 7/1984 Docking et al. ..... 224/181
4,803,980 A * 2/1989 Nowakowski et al. . 128/202.27
5,156,146 A * 10/1992 Corces et al. ..... 128/201.24
5,191,317 A * 3/1993 Toth et al. ..... 128/201.22
5,309,901 A * 5/1994 Beaussant ..... 128/201.22
5,349,949 A * 9/1994 Schegerin ..... 128/201.24
5,577,495 A * 11/1996 Murphy ..... 128/201.22
5,630,412 A * 5/1997 Dubruille et al. ..... 128/201.22
6,044,844 A * 4/2000 Kwok et al. ..... 128/205.25
6,118,382 A * 9/2000 Hibbs et al. ..... 340/573.1

FOREIGN PATENT DOCUMENTS

GB 2166189 A * 4/1986 ..... F16B/21/16

* cited by examiner

*Primary Examiner*—William C. Doerrler
*Assistant Examiner*—Mohammad M. Ali
(74) *Attorney, Agent, or Firm*—Keusey, Tutunjian & Bitetto, P. C.

(57) ABSTRACT

A universal oxygen mask bayonet and bayonet receiver deflector includes a bayonet receiver deflector disposed on the helmet between the bayonet receiver and helmet, and a bayonet deflector connected to the oxygen mask bayonet. The bayonet receiver deflector includes a contoured side for providing a smooth transition between the helmet and the bayonet receiver on at least one side of the bayonet receiver. The oxygen mask bayonet deflector is made of two parts consisting of a bayonet ramp deflector and a bayonet tab deflector. The bayonet ramp deflector includes a ramped side and the bayonet tab deflector is generally frusto-conical in shape and includes a stem and a notch on the stem. The contoured side of the bayonet receiver deflector, the ramped side of the bayonet ramp deflector and the frusto-conical shape of the tab deflector cooperate to eliminate all potential hang up points and thereby parachute riser and/or shroud line entanglement with the oxygen mask bayonet, bayonet tab and the bayonet receiver during pilot ejection.

20 Claims, 10 Drawing Sheets

UNIVERSAL OXYGEN MASK BAYONET AND BAYONET RECEIVER DEFLECTOR

BACKGROUND OF THE INVENTION

1. Field of the Invention

The invention relates generally to military tactical aircraft oxygen mask bayonet and bayonet receiver assemblies. More particularly, it relates to an apparatus for reducing the risk of parachute riser entanglement with the oxygen mask bayonet and bayonet receiver in the event of ejection.

2. Description of the Prior Art

The ejection from an aircraft during an emergency subjects the pilot to various torso loads. These loads must be considered in the design, implementation and deployment of parachutes for the pilots during the emergency ejection scenario. In addition, the type of aircraft and the corresponding ejection schedule must also be considered in order to assure safety during parachute deployment. Thus, the deployment of the parachute and corresponding riser and shroud lines in the emergency ejection situation has proven to be a significant design aspect of the entire pilot helmet and oxygen mask connection thereto.

By way of example, the Harrier Aircraft (AV-8B) has an ejection seat configuration that is unlike all other fixed wing pilot ejection seats. The AV-8B ejection schedule includes a low altitude high acceleration that subjects the pilot to higher than normal torso loads. It has been demonstrated that for all ranges of air speeds, the parachute riser lines are sure to contact the side of the pilot helmet during deployment. This riser contact is not subtle, rather it typically manifests itself as "riser slap", a known condition that subjects the pilot to unsafe and possibly fatal head and neck forces.

Referring to the prior art FIGS. 1–3, there is shown an exemplary helmet 10 having a visor 12 and other operational equipment mounted thereon. The oxygen mask strap holder 14, which is attached to the oxygen mask (not shown) via straps 15*a* and 15*b*, includes an oxygen mask bayonet 16 that is releasably inserted into a bayonet receiver 30 mounted onto the respective sides of the helmet 10. The bayonet 16 includes a bayonet tab 18, ratchet-like pawls 19*a* and 19*b* and a distal end 20. During operation, end 20 is inserted into opening 32 in bayonet receiver 30, and ratchet pawls 19*a* and 19*b* engage corresponding notches (not shown) within receiver 30 to adjustably lock the position of the connected oxygen mask with respect to the helmet and onto the pilots face. Generally, there are four (4) positions or clicks that bayonet 16 can make when inserted into bayonet receiver 30. These four (4) positions determine how tightly the oxygen mask is positioned on the pilot's face and enable pilot adjustment of the same.

The bayonet receiver 30 includes two mounting holes 34*a* and 34*b* that receive screws from the underside of the helmet. In order to release the oxygen mask, the pilot simply pulls down on bayonet tab 18 (in the direction of the arrow in FIG. 2), thereby releasing pawls 19*a* and 19*b* from their engagement within receiver 30 and causing the bayonet to slide out of the receiver.

Unfortunate accidents have resulted in a reconsideration of the oxygen mask bayonet 16 and bayonet receiver 30 configuration on the pilot's helmet. It has been determined that during ejection and parachute deployment, the riser and shroud lines can get caught or hung up on any one of the bayonet tab 18, the bottom edges 36 of bayonet receiver 30 and/or the aft end 20 of bayonet 16 that protrudes beyond receiver 30 (FIG. 3). These potential hang up hazards are on both sides of the helmet and thereby create the potential for a fatality during ejection. It is also possible that the riser and shroud lines could cause inadvertent release of one of the bayonets during ejection, thereby increasing the risk of injury and/or fatality to the air crew during ejection.

It is therefore desirable to retrofit the existing oxygen mask bayonet and bayonet receiver with a deflector that eliminates the potential for riser entanglement with the bayonet and/or bayonet receiver during ejection and parachute deployment.

SUMMARY OF THE INVENTION

It is therefore an object of the present invention to provide a universal deflector for the oxygen mask bayonet and bayonet receiver for pilot helmets of various sizes.

It is another object of the invention to provide a universal deflector for the oxygen mask bayonet and bayonet receiver that is easily installed and replaced for both new and retrofit applications.

It is yet another object of the invention to provide a universal deflector for the oxygen mask bayonet and bayonet receiver that does not require re-tooling of the existing bayonet and bayonet receiver assemblies.

These and other objects are achieved in accordance with an embodiment of the invention wherein a bayonet receiver deflector is disposed on the helmet between the bayonet receiver and helmet, and a bayonet deflector is connected to the oxygen mask bayonet. The bayonet receiver deflector includes a contoured side for providing a smooth transition between the helmet and the bayonet receiver on at least one side of the bayonet receiver, and means for securing the bayonet receiver deflector to the helmet. The oxygen mask bayonet deflector is made of two parts consisting of a bayonet ramp deflector and a bayonet tab deflector. The bayonet ramp deflector includes a ramped side and a bayonet tab portion and means for connecting the deflector to the oxygen mask bayonet. The bayonet tab portion includes a slot in an upper side thereof and an opening in a rear side thereof aligned with a hole in the bayonet tab.

The bayonet tab deflector is generally frusto-conical in shape and includes a stem and a notch on the stem. In order to secure the bayonet tab deflector to the ramped deflector, the stem passes through a hole in the bayonet tab and into the opening in the rear side of the bayonet tab portion of said bayonet ramp deflector. An e-clip or other releasable clip engages the notch in the stem from through the opening in the bayonet tab portion of the bayonet ramped deflector and secures the tab deflector to the bayonet ramp deflector by sandwiching the bayonet tab between the two parts.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION OF PREFERRED EMBODIMENTS

Figure 1:
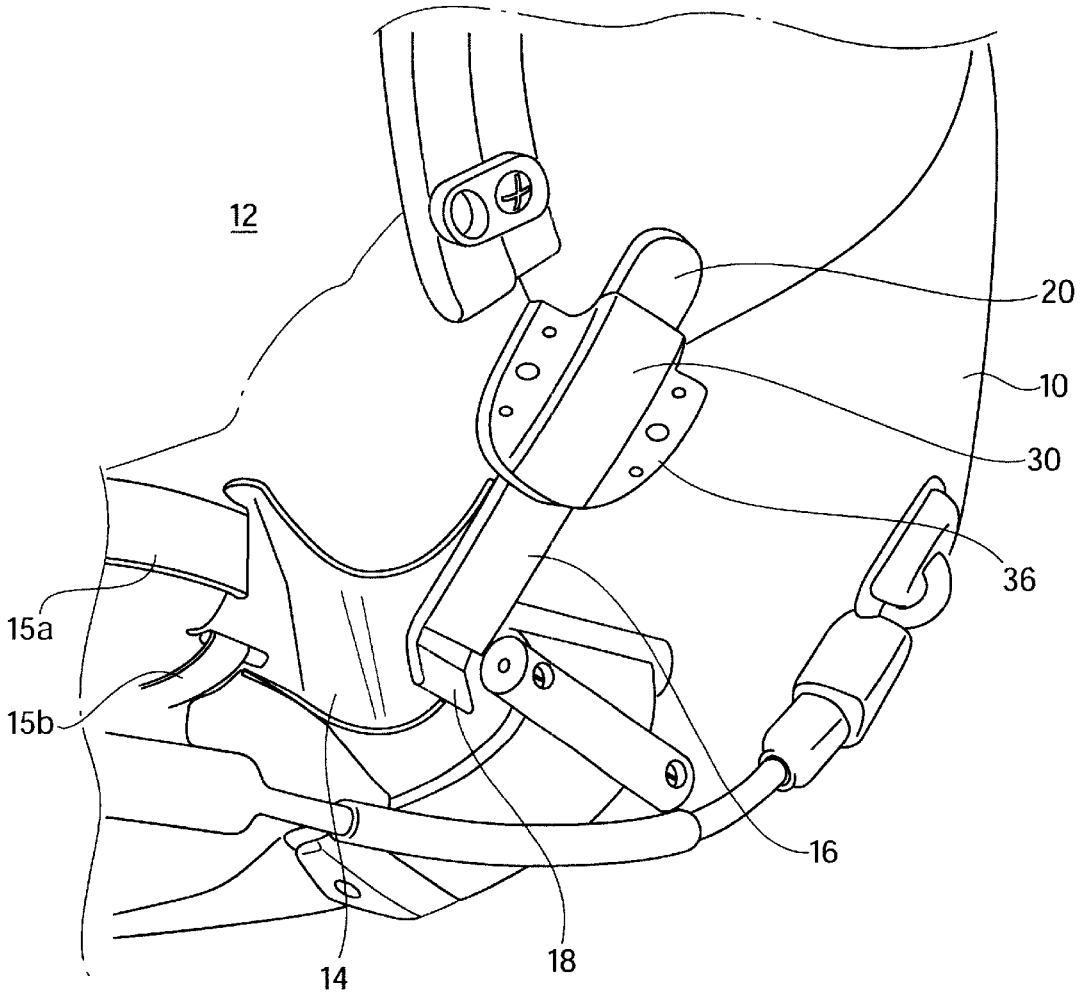
FIG. 1 (Prior Art)
FIG. 1 is a partial perspective view of a pilot helmet with the oxygen mask bayonet and bayonet receiver according to the prior art.
Figure 2:
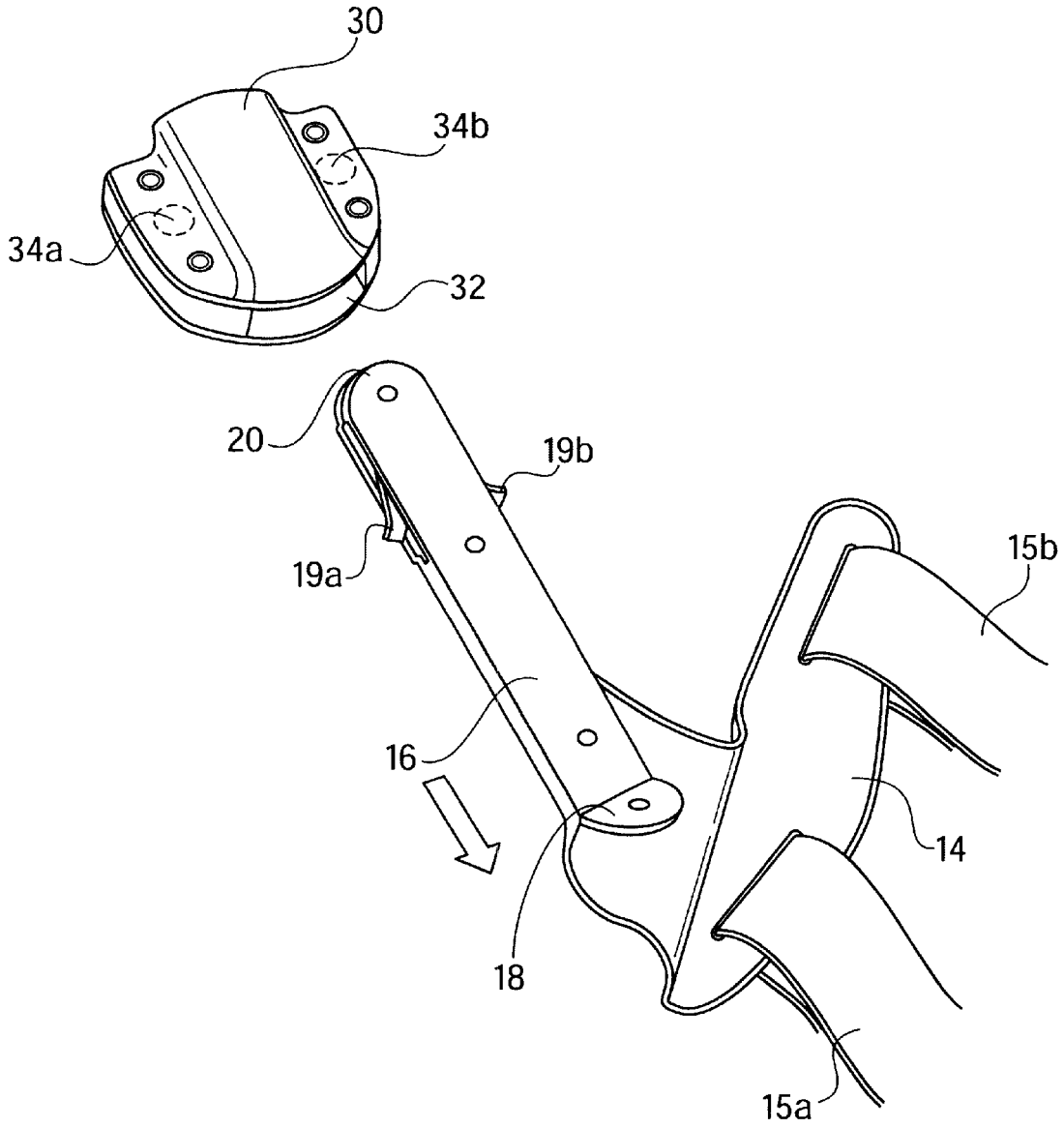
FIG. 2 (Prior Art)
FIG. 2 is a perspective view of the prior art oxygen mask bayonet and bayonet receiver before engagement.

Referring to FIGS. 4 through 8, there is shown the universal deflector 40 according to an embodiment of the invention. The universal deflector 40 is made up of a bayonet receiver deflector 42, a bayonet ramp deflector 60 and a bayonet tab deflector 72.

Figure 5:
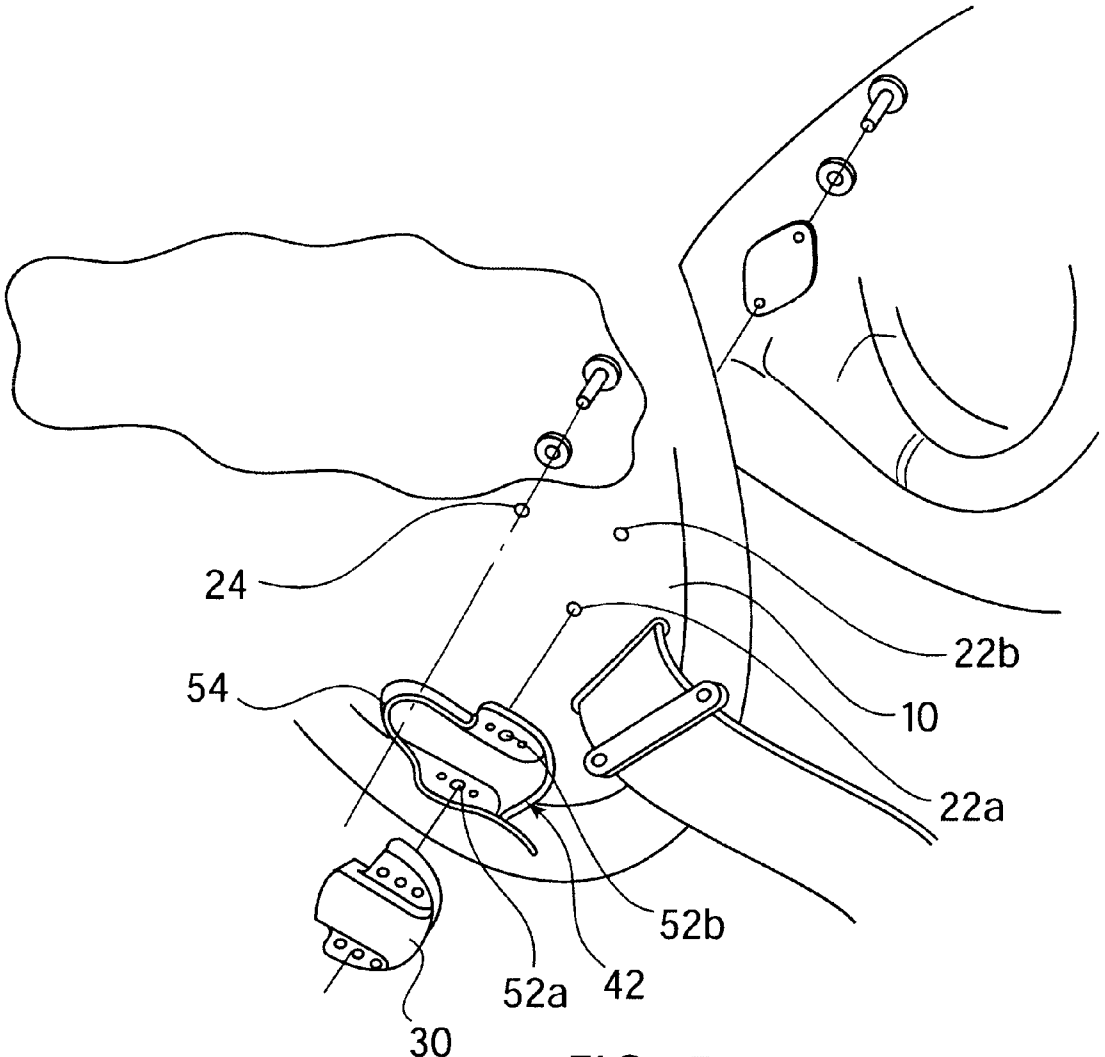
FIG. 5 is a perspective view of the bayonet receiver deflector being retrofitted onto an existing helmet according to an embodiment of the invention.

The bayonet receiver deflector 42 is designed to be disposed between the helmet 10 and the bayonet receiver 30 and includes an upper portion or surface 44 that is configured to receive and support the bayonet receiver 30, a lower portion or surface that is contoured to be flush mounted on the respective sides of the helmet 10, and a contoured side portion 48 having an extended portion 49. The bayonet receiver deflector 42 contains three attachment points; a pair of mounting holes 52*a* and 52*b* corresponding in position to screw holes 34*a* and 34*b* on the bayonet receiver 30 that allow the receiver 30 to be mounted onto the helmet 10 through bayonet receiver deflector 42, and a third mounting hole 54 for securing the aft portion 50 of the receiver deflector 42 to the helmet 10. By elongating one of mounting holes 52*a* and 52*b* (e.g., mounting hole 52*b*), a rotational features is built into receiver deflector 42 to provide optimum positioning of the deflector 42 after the mounting holes 22*a* and 22*b* for the bayonet receiver 30 have been drilled into helmet 10 (FIG. 5).

Bayonet receiver deflector 42 includes an aft portion 50 that also includes the aforementioned mounting hole 54. This additional mounting requires the drilling of another hole 24 into helmet 10 once bayonet receiver deflector 42 is aligned and/or mounted with holes 22*a* and 22*b* in helmet 10. The contoured side 48 and extended portion 49 are designed so as to create a smooth transition between the helmet surface and the bayonet receiver and the end 20 of the bayonet. This smooth transition effectively eliminates the aforementioned hang up hazard points on the bayonet receiver 30 and the aft end 20 of the oxygen mask bayonet 16.

According to one preferred embodiment, bayonet receiver deflector 42 is made of high density polyethylene (HDPE). HDPE has been selected by design due to its low flexural modulus, which is an important mechanical property that is required to permit yielding of the deflector as it is drawn down (fastened) in various positions for each of several different size helmets. Those of skill in the art will recognize that other materials may be used for the bayonet receiver deflector without departing from the spirit of the invention.

Figure 4A:
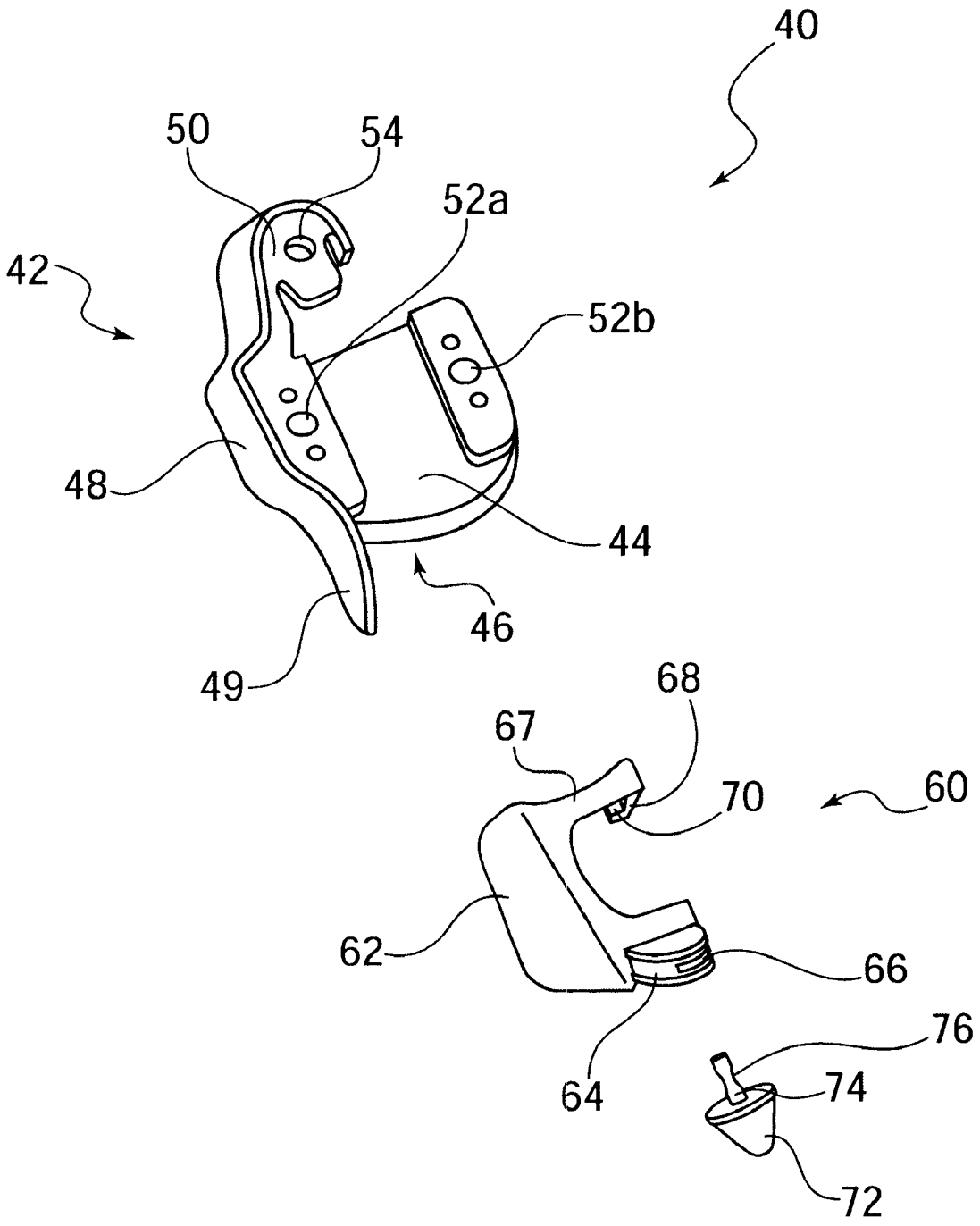
FIG. 4*a* is a perspective view of the universal bayonet and bayonet receiver deflector assembly according to an embodiment of the invention.
Figure 4B:
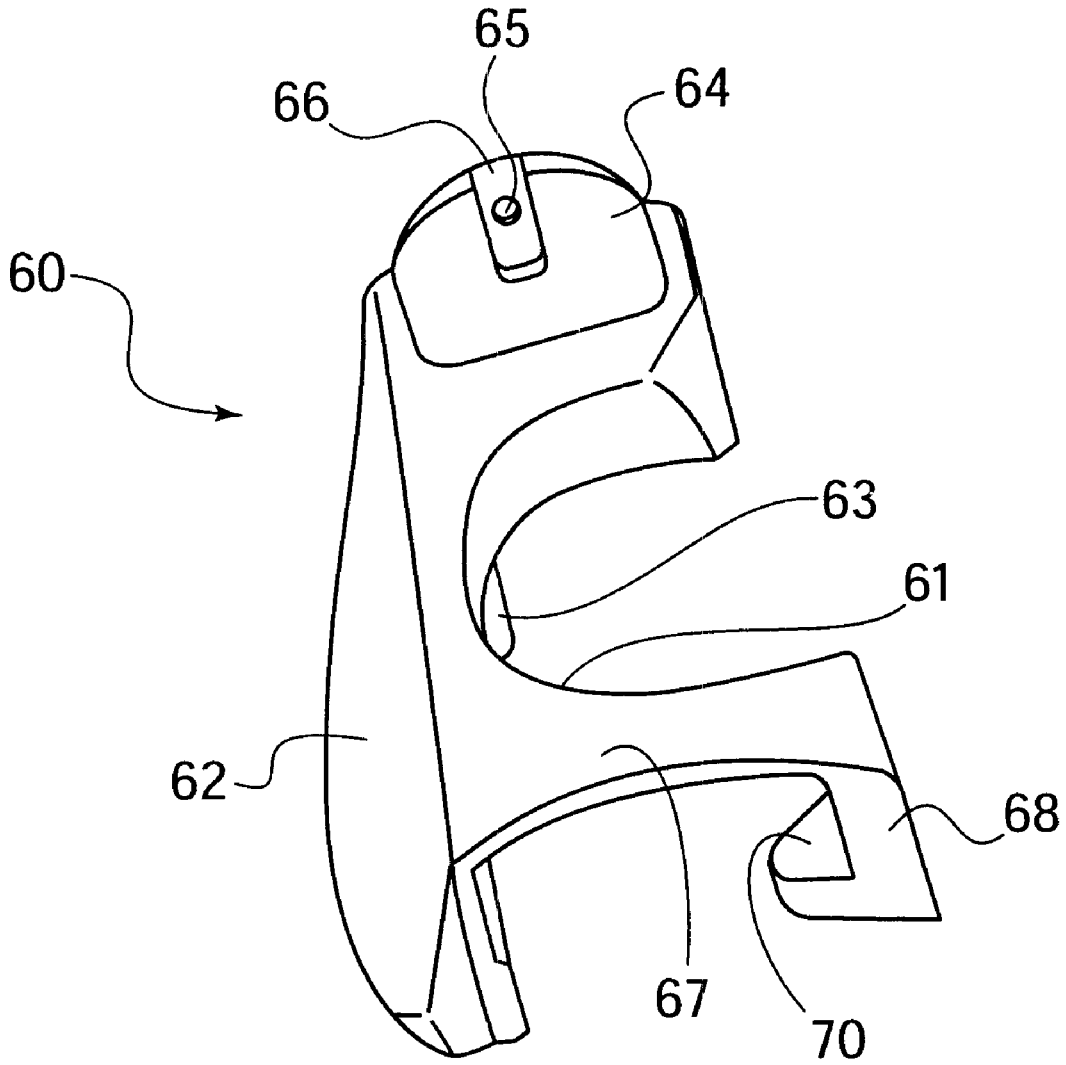
FIG. 4*b* is a perspective view of the bayonet ramp deflector according to an embodiment of the invention.
Figure 6:
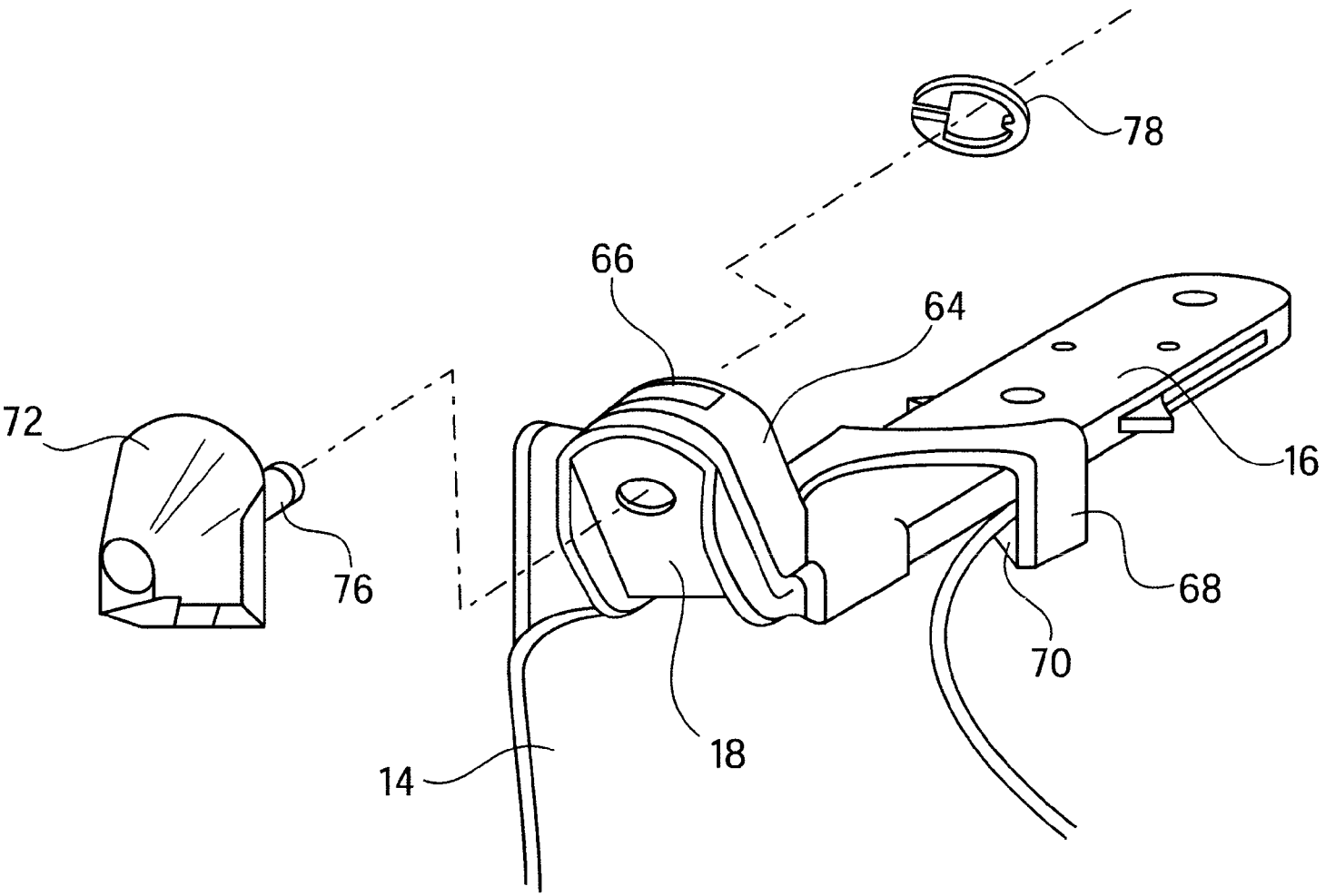
FIG. 6 is a perspective view of the connection of the bayonet ramp deflector and bayonet tab deflector according to an embodiment of the invention.

The other two parts of the universal bayonet deflector are the bayonet ramp deflector 60 and the bayonet tab deflector 72. Referring to FIGS. 4*a*, 4*b* and 6, bayonet ramp deflector 60 includes a finger relief cut-out 61, a ramped or sloped side 62 and a tab portion 64 having a slot 66 therein. The tab portion includes a hole 65 for receiving the stem of the tab deflector. In order to secure the ramp deflector 60 to the oxygen mask bayonet 16, a flange 63 on the same side as the ramped side 62 engages the underside of the bayonet 16 on the same side of the ramped side 62 (FIG. 4*b*). An arm 67 is integral with and extends from the ramped side 62 such that is passes over the top of bayonet 16. Leg 68 with corresponding foot 70 is connected to the arm 67 and enables the opposing side of the ramp deflector 60 to be secured around the underside of the bayonet 16 such that tab portion 64 abuts bayonet tab 18.

Through engineering analysis, it has been determined that the bayonet 16 experiences operational jamming with an applied torque at the bayonet tab 18. The design of that bayonet ramp deflector has taken into consideration this potential jamming at the bayonet when the tab 18 is subject to a relatively small torque. Through the implementation of the finger relief cut-out 61, when the bayonet ramp deflector 60 is actuated at tab portion 64, a small rotative torque is applied to the bayonet tab 18 that can initiate bayonet jamming. This operation jamming is desired to preclude the possibility of inadvertent bayonet release for the scenario where the riser makes contact with the bayonet tab during parachute deployment. The finger relief cut-out 61 eliminates this operational jamming during planned bayonet disengagement by creating a straight line sliding action of the ramp deflector 60 and removing the created rotational moment by the actuation of the tab portion 64. In addition, the finger relief cut-out 61 has been designed to accommodate all hand wear (e.g., gloves) used by the air crew.

The bayonet ramp deflector 60 not only serves as an omni-directional strike deterrent, but also acts as an interface between the bayonet and the bayonet receiver deflector by providing smooth insertion into the bayonet receiver deflector and further acts to inhibit accidental disengagement of the bayonet 16.

The bayonet tab deflector 72 is substantially frusto conical in shape and therefore does not have a pointed end. This shape converts the otherwise exposed bottom side of the bayonet tab 18 into a streamlined surface with the ramped bayonet deflector 60. This frusto-conical design enables the tab deflector 72 to also serve as an omni-directional strike deterrent.

The tab deflector includes a stem 74 having a notch 76 therein. As shown in FIGS. 4*a*, 4*b* and 6, when bayonet ramp deflector 60 is mounted on bayonet 16 as shown, the stem 74 of tab deflector 72 passes through a hole in bayonet tab 18, through hole 65 and into the tab portion 64. An e-clip 78 can then be inserted into slot 66 so as to engage notch 76 in stem 74 and secure bayonet tab deflector 72 in its operable position against bayonet tab 18. Once the ramp deflector 60 and tab deflector 72 are secured as shown, the combination of parts move together with the bayonet tab 18 such that the operation of bayonet 16 remains unchanged. Thus, when the pilot pulls down on tab portion 64 (in the direction of the arrow in FIG. 7), the ramp deflector 60 with tab deflector 72 move with the tab 18 to release the locking pawls 19*a* and 19*b* from their engagement within bayonet receiver 30.

The bayonet ramp deflector 60 and tab deflector 72 are preferably made from acetal, which is chosen due to its inherent lubricity, and desirable mechanical and physical properties. However, those of ordinary skill in the art will readily recognize that other materials may be used to implement the bayonet ramp deflector 60 and tab deflector 72 without departing from the spirit of the invention.

Figure 3:
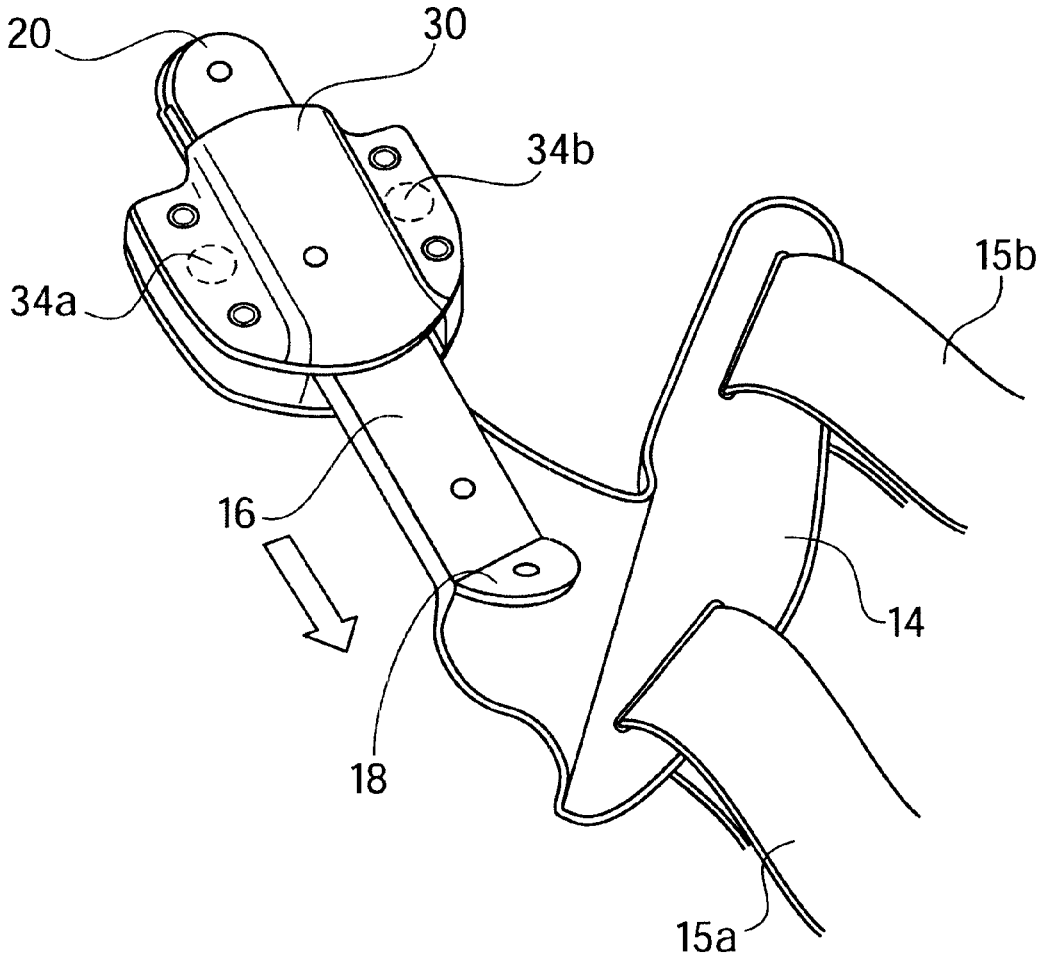
FIG. 3 (Prior Art)
FIG. 3 is a perspective view of the prior art oxygen mask bayonet and bayonet receiver after engagement.
Figure 7:
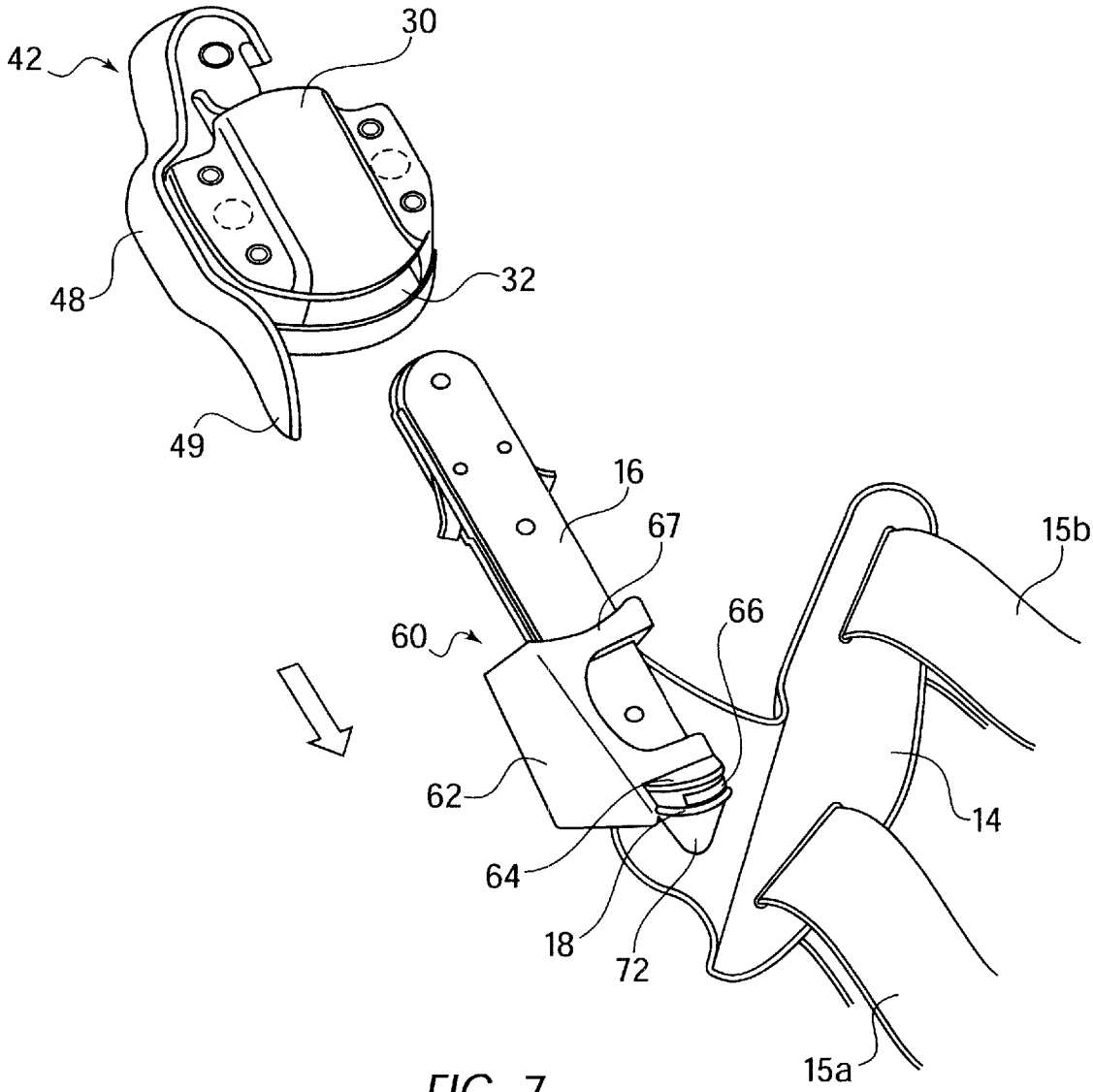
FIG. 7 is a perspective view of the universal bayonet and bayonet receiver deflectors in position before connection of the oxygen mask bayonet with the bayonet receiver.

Referring to FIG. 7, the bayonet receiver deflector 42 is mounted to the helmet (not shown) with the bayonet receiver 30 secured to the upper side thereof, and the bayonet ramp deflector 60 is mounted on the bayonet 16 with the tab deflector 72 secured in position as explained previously with reference to FIG. 6. The contoured side 48 of bayonet receiver deflector 42 includes an extended portion 49 that is adapted to maintain continuity between the side portion 48 and the ramped side 62 of the ramp deflector 60 when the bayonet 16 is engaged with bayonet receiver 30 in a loose manner. When bayonet 16 is engaged with the bayonet receiver 30 (FIG. 8), the contoured side 48 of bayonet receiver deflector 42, the ramped side 62 of ramp deflector 60 and the conical portion of tab deflector 72 all cooperate to eliminate the aforementioned potential hazards created by bayonet tab 18, the edge 36 of bayonet receiver 30 and/or the bayonet end 20 that protrudes beyond receiver 30 (See FIG. 3).

Figure 8:
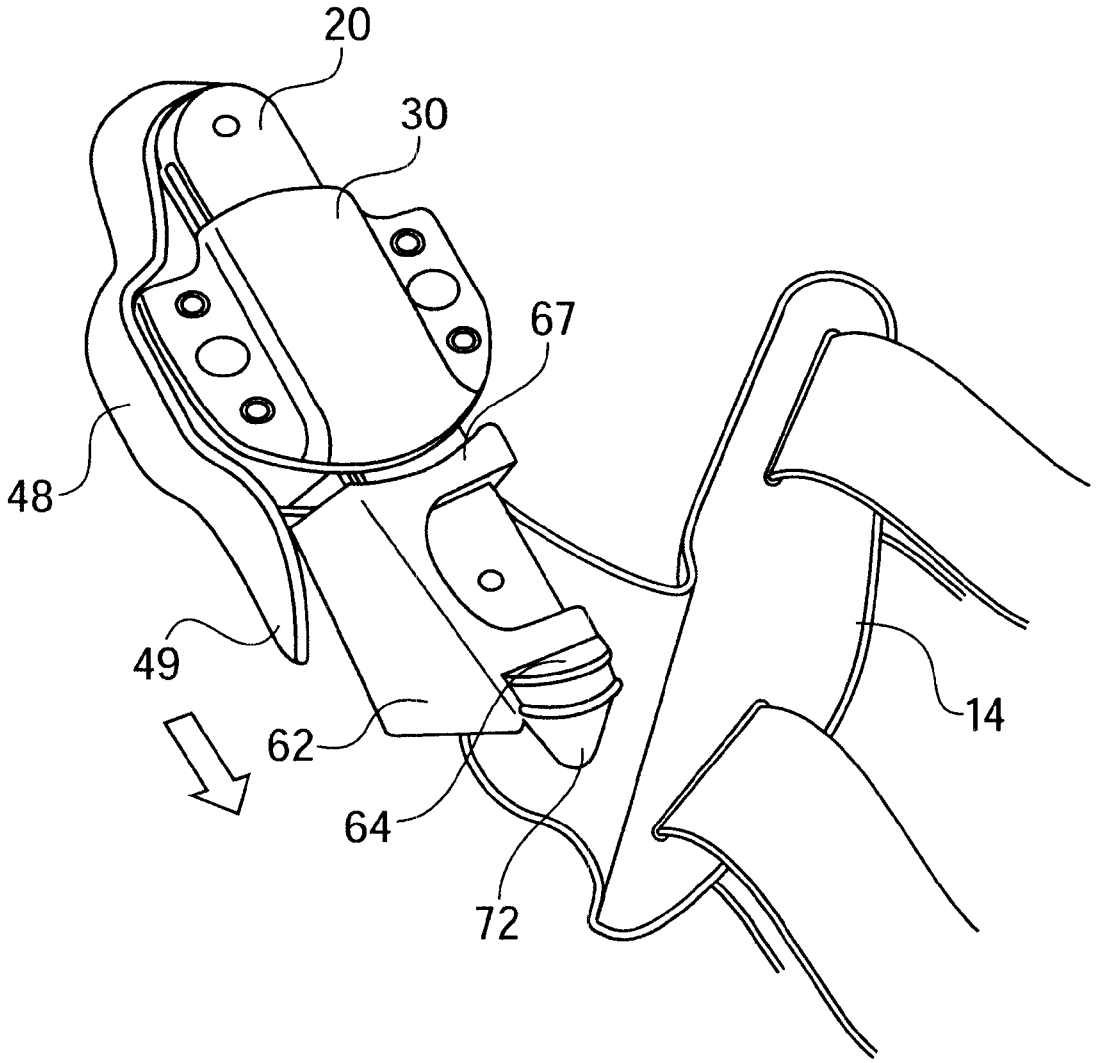
FIG. 8 is a perspective view of the universal bayonet and bayonet receiver deflectors in position when the oxygen mask bayonet is engaged with the bayonet receiver.
Figure 9:
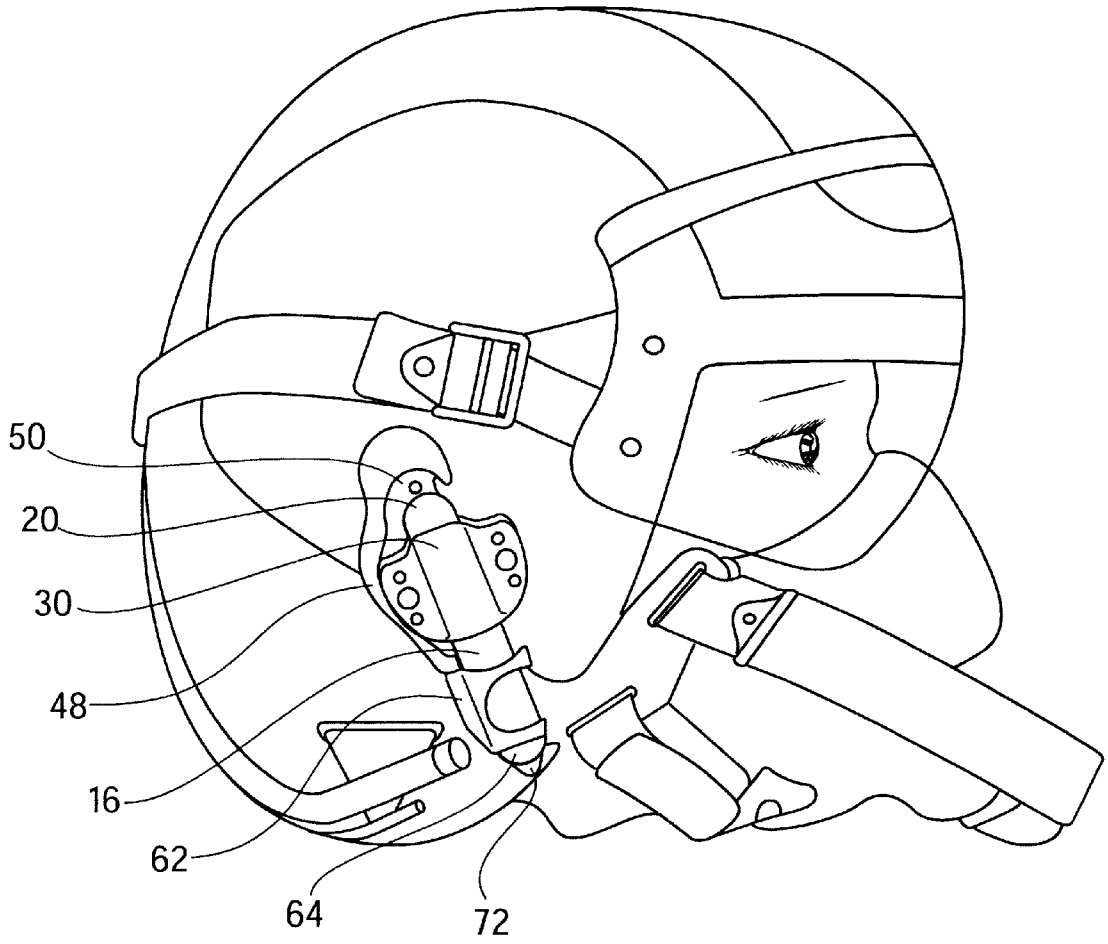
FIG. 9 is a side view of the universal bayonet and bayonet receiver deflectors as mounted on a helmet in accordance with an embodiment of the invention.

Referring to FIGS. 8 and 9, the potential hazard created by bayonet end 20 is protected by the bayonet receiver deflector end portion 54. Thus, regardless of the operable position of bayonet 16 within bayonet receiver 30 (e.g., fully inserted or partially inserted), the end portion 54 of the bayonet receiver deflector eliminated any potential hazard created by the end 20 of bayonet 16. As shown in FIG. 9, when the bayonet receiver deflector 42 is mounted on the helmet 10 and the corresponding bayonet ramp deflector 60 and tab deflector 72 are mounted on the bayonet 16, all potential hazards or hang up points for parachute riser and deployment during ejection are eliminated.

While there have shown and described and pointed out fundamental novel features of the invention as applied to preferred embodiments thereof, it will be understood that various omissions and substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A deflector assembly for an oxygen mask bayonet and a bayonet receiver mounted on a helmet, the bayonet having a bayonet tab, the deflector comprising:

a bayonet receiver deflector being disposed on the helmet between the bayonet receiver and helmet; and a bayonet deflector connected to the oxygen mask bayonet;

wherein said bayonet receiver deflector and said bayonet deflector cooperate to prevent parachute riser and/or shroud line entanglement with the oxygen mask bayonet, bayonet tab and the bayonet receiver during ejection.

2. The deflector according to claim 1, wherein said bayonet receiver deflector further comprises:

a contoured side for providing a smooth transition between the helmet and the bayonet receiver on at least one side of the bayonet receiver; and means for securing the bayonet receiver deflector to the helmet.

3. The deflector according to claim 2, wherein said bayonet deflector further comprises:

a bayonet ramp deflector having means for connecting to the bayonet, a ramped side and a bayonet tab portion, said bayonet tab portion including a slot in an upper side thereof and an opening in a rear side thereof;

a bayonet tab deflector having stem and a notch on said stem, said stem passing through a hole in the bayonet tab and into said opening in the rear side of the bayonet tab portion of said bayonet ramp deflector, said bayonet tab deflector having a substantially frusto-conical shape; and means for securing said bayonet tab deflector stem to said bayonet ramp deflector.

4. The deflector according to claim 3, wherein said means for securing said bayonet ramp deflector comprises an e-clip inserted through said slot in said bayonet tab portion of said bayonet ramp deflector and engaging said notch on said bayonet tab deflector stem.

5. The deflector according to claim 3, wherein said means for connecting said bayonet ramp deflector to the oxygen mask bayonet comprises:

a flange engaging an underside of the oxygen mask bayonet on said ramped side;

an arm extending from said ramped side across an upper side of the bayonet;

a leg connected to said arm; and a foot connected to said leg and positioned to engage the underside of the oxygen mask bayonet on a side opposing said ramped side, wherein said flange, arm, leg and foot secure said ramp deflector onto said bayonet such that said bayonet tab portion abuts the bayonet tab.

6. The deflector according to claim 3, wherein said bayonet ramp deflector and said bayonet tab deflector is made of acetal.

7. The deflector according to claim 2, wherein said bayonet receiver deflector is made of high density polyethylene.

8. The deflector according to claim 2, wherein said means for securing said bayonet receiver deflector comprises a bolt hole pattern on said bayonet receiver deflector common with that of the bayonet receiver such that mounting screws can engage the bayonet receiver through said bayonet receiver deflector, said bolt hole pattern including a rotational feature for further enabling accurate positioning of said bayonet receiver deflector onto the helmet.

9. The deflector according to claim 8, wherein said rotational feature comprises at least one elongated hole in said bolt hole pattern, said elongated hole allowing a degree of rotation about at least one other hole in said bolt hole pattern.

10. The deflector according to claim 3, wherein said contoured side of said bayonet receiver deflector extends in a direction toward the bayonet beyond the bayonet receiver such that said ramped side of said bayonet ramp deflector is disposed within said contoured side of the bayonet receiver deflector when the oxygen mask bayonet is secured within the bayonet receiver.

11. A deflector for an oxygen mask bayonet and a bayonet receiver mounted on a helmet, the bayonet having a bayonet tab, the deflector comprising:

a bayonet receiver deflector being disposed on the helmet between the bayonet receiver and helmet, said bayonet receiver deflector having a contoured side providing a smooth transition between the helmet and the bayonet receiver on at least one side of the bayonet receiver;

a bayonet deflector connected to the oxygen mask bayonet and having surfaces providing a smooth transition between the oxygen mask bayonet, the helmet and the bayonet receiver deflector;

wherein said contoured side and said surfaces cooperate to prevent parachute riser and/or shroud line entanglement with the oxygen mask bayonet, bayonet tab and the bayonet receiver during ejection.

12. The deflector according to claim 11, wherein said bayonet deflector further comprises:

a bayonet ramp deflector having means for connecting to the bayonet, a variably sloped side and a bayonet tab portion, said bayonet tab portion including a slot in an upper side thereof and an opening in a rear side thereof;

a bayonet tab deflector having stem and a notch on said stem, said stem passing through a hole in the bayonet tab and into said opening in the rear side of the bayonet tab portion of said bayonet ramp deflector, said bayonet tab deflector having a substantially frusto-conical shape that cooperates with said variably sloped side to eliminate a potential entanglement point at the bayonet tab; and means for securing said bayonet tab deflector stem to said bayonet ramp deflector.

13. The deflector according to claim 12, wherein said means for securing said bayonet ramp deflector comprises an e-clip inserted through said slot in said bayonet tab portion of said bayonet ramp deflector and engaging said notch on said bayonet tab deflector stem.

14. The deflector according to claim 12, wherein said means for connecting said bayonet ramp deflector to the oxygen mask bayonet comprises:

a flange engaging an underside of the oxygen mask bayonet on said ramped side;

an arm extending from said ramped side across an upper side of the bayonet;

a leg connected to said arm; and a foot connected to said leg and positioned to engage the underside of the oxygen mask bayonet on a side opposing said ramped side, wherein said flange, arm, leg and foot secure said ramp deflector onto said bayonet such that said bayonet tab portion abuts the bayonet tab.

15. The deflector according to claim 12, wherein said means for securing said bayonet receiver deflector comprises a bolt hole pattern on said bayonet receiver deflector common with that of the bayonet receiver such that mounting screws can engage the bayonet receiver through said bayonet receiver deflector, said bolt hole pattern including a rotational feature for further enabling accurate positioning of said bayonet receiver deflector onto the helmet.

16. The deflector according to claim 15, wherein said rotational feature comprises at least one elongated hole in said bolt hole pattern, said elongated hole allowing a degree of rotation about at least one other hole in said bolt hole pattern.

17. The deflector according to claim 11, wherein said bayonet deflector is made of Acetal.

18. The deflector according to claim 11, wherein said bayonet receiver deflector is made of high density polyethylene.

19. An apparatus mounted on a helmet for deflecting parachute riser and shroud line entanglement with a lower edge of an oxygen mask bayonet receiver comprising:

a bayonet receiver deflector forming a smooth transitional surface between the lower edge of the bayonet receiver and the helmet.

20. An apparatus mounted on the sliding release tab of an oxygen mask bayonet for deflecting parachute riser and shroud line entanglement with a lower edge of the bayonet comprising:

a bayonet deflector attached to the bayonet tab and wrapping partially around the bayonet to form a sloping transitional surface at the lower edge while providing clearance for the sliding of the tab.

* * * * *